US007143985B2

(12) United States Patent
Barnes

(10) Patent No.: US 7,143,985 B2
(45) Date of Patent: Dec. 5, 2006

(54) BABY CHAIR BOTTLE SUPPORT FEEDER DEVICE

(75) Inventor: Reginald Barnes, 20 Wick St., Buffalo, NY (US) 14212

(73) Assignee: Reginald Barnes, Niagara Falls, NY (US)

( * ) Notice: Subject to any disclaimer, the term of this patent is extended or adjusted under 35 U.S.C. 154(b) by 119 days.

(21) Appl. No.: 10/932,757

(22) Filed: Sep. 2, 2004

(65) Prior Publication Data

US 2005/0248190 A1 Nov. 10, 2005

Related U.S. Application Data

(60) Provisional application No. 60/568,950, filed on May 7, 2004.

(51) Int. Cl.
*A47D 15/00* (2006.01)

(52) U.S. Cl. ..... 248/106

(58) Field of Classification Search ..... 248/102, 248/103, 105, 106
See application file for complete search history.

(56) References Cited

U.S. PATENT DOCUMENTS 2,638,296 A * 5/1953 Battle ..... 248/105
2,991,032 A * 7/1961 Theis ..... 248/102
3,222,020 A * 12/1965 Rea ..... 248/106
5,037,046 A * 8/1991 Mingledorff, Jr. ..... 248/106
5,092,549 A * 3/1992 Beech ..... 248/103
5,263,673 A * 11/1993 Yang ..... 248/103
5,577,692 A * 11/1996 Rollins ..... 248/106
5,794,898 A * 8/1998 Bradley et al. ..... 248/102
5,823,486 A * 10/1998 Smith et al. ..... 248/104
5,927,661 A * 7/1999 Tinsley et al. ..... 248/102

* cited by examiner

*Primary Examiner*—Ramon O Ramirez
(74) *Attorney, Agent, or Firm*—Vincent G. LoTempio

(57) ABSTRACT

A feeding support device that is attachable to an infant carrier seat comprising a support arm that is rotatably attached to support rods, a bottle-mounting bracket assembly rotatably mounted to the support arm, a bottle mount having a first end attached to the bottle-mounting bracket assembly and a second end operatively arranged to fasten a bottle to the bottle mount. A coiled spring for rotating the bottle-mounting bracket assembly and combination of a pneumatically regulated air shock and a coiled spring for rotating the support arm.

4 Claims, 3 Drawing Sheets

FIG. 4
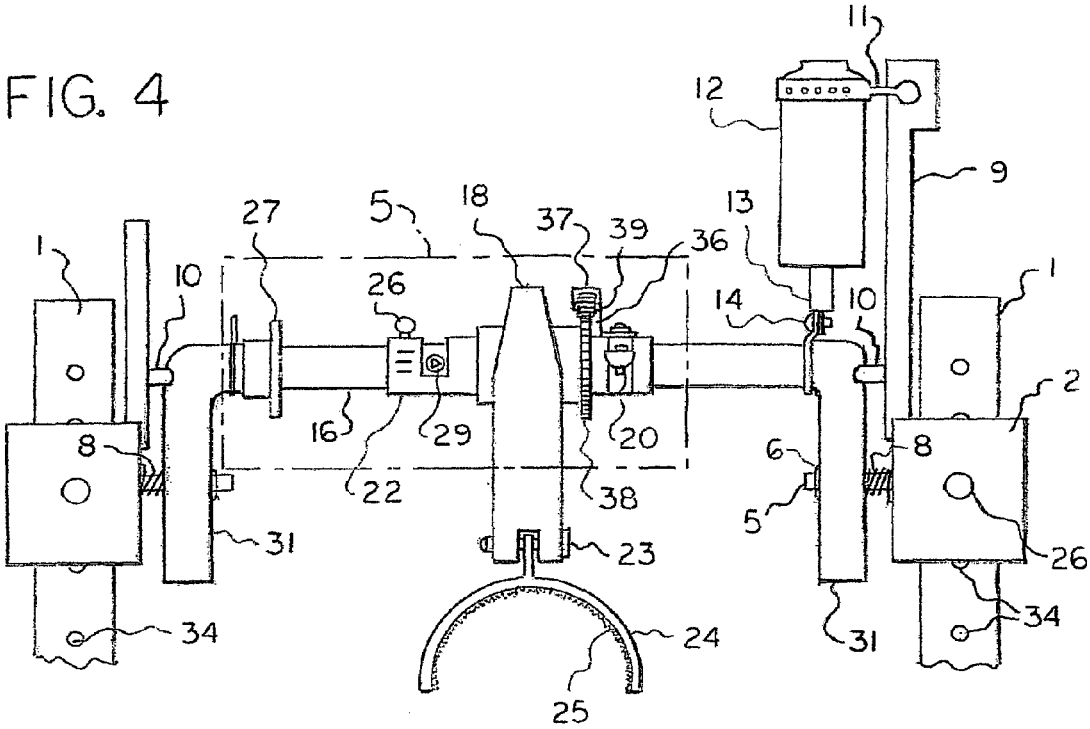
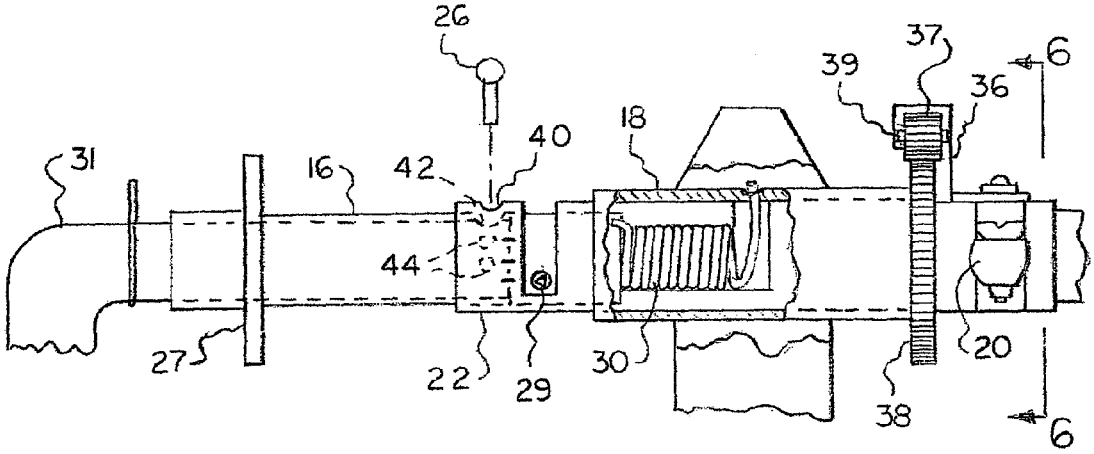
FIG. 5

BABY CHAIR BOTTLE SUPPORT FEEDER DEVICE

This application claims priority of United States Provisional Patent Application 60/568,950, filed on May 7, 2004, titled: THE BABY CHAIR BOTTLE SUPPORT FEEDER DEVICE.

BACKGROUND OF THE INVENTION

The present invention relates generally to drinking container support devices, and more particularly to a spring tension and pneumatically regulated infant feeding container support apparatus that is attachable to an infant carrier seat.

There are several types of infant feeding devices on the market today because bottle feeding an infant is difficult and time-consuming. The bottle must be retained in the correct position for the infant to drink and removed when the infant is finished drinking. When the infant is too young to grasp a feeding bottle, the caregiver must hold the bottle for the infant for the entire time necessary to satisfy the child's need. Often a child is unable to manipulate a bottle properly if left alone in a car seat or other similar infant carrier seat with the drinking device or bottle. The caregiver necessarily has to be present and available to properly hold or position the bottle. This may be difficult if the infant is in a car seat while the caregiver is driving or otherwise occupied.

There are many types of baby bottle holders on the market today. Some infant feeding support devices rest on the baby's chest with straps to secure the bottle holder around the baby, while other designs use a clamp to secure the bottle holder to car seat or crib, or a foam wedge and strap to secure the baby bottle. While many designs are adequate for the basic purpose and function of holding a baby bottle no design addresses the problem of removing the bottle from the grasp of the infant when feeding is complete.

Many prior attempts have been made to alleviate the problems associated with infant bottle supports for example U.S. Pat. No. 5,823,486 (Smith) teaches a device with a flexible arm which is able to be moved or maneuvered into a number of different positions or orientations. U.S. Pat. No. 6,098,934 (Skelton) describes a drinking container support apparatus comprised of a wedge, a drinking container retaining member and a strap for attaching the drinking container support apparatus to a carrier seat. While the prior designs are adequate for the basic purpose and function of holding a baby bottle there is no device that removes the bottle from the infant when feeding is complete. Thus it is readily apparent that there is a long felt need for a spring tension pneumatically regulated drinking container support apparatus for removably presenting an infant's drinking container that is attachable to an infant carrier seat.

SUMMARY OF THE INVENTION

It is a general object of the present invention to provide a feeding support device suitable for attachment to a car seat, carriage, high chair or carrier seat.

It is a further object to provide a feeding support device that pulls away from a baby's mouth when not in use.

It is a still further object to provide a feeding support device that is self-locking to grip a variety of bottle shapes and widths and provides a wide base for stability.

It is another object to provide a feeding support device to hold a bottle during feeding and with spring tension resistant air regulated withdrawal pull the bottle away upon completion.

It is a further object to provide a feeding support device that supports a baby bottle in a mount from which it can be easily attached and detached.

It is an even further object to provide a feeding support device having dual pressure sprocket design which controls the force of the spring tensions torque withdrawal of the bottle.

The above and other objects are accomplished in accordance with the present invention which comprises a feeding support device that is attachable to an infant carrier seat comprising a support arm that is rotatably attached to support rods, a bottle-mounting bracket assembly rotatably mounted to the support arm, a bottle mount having a first end attached to the bottle-mounting bracket assembly and a second end operatively arranged to fasten a bottle to the bottle mount. A coiled spring for rotating the bottle-mounting bracket assembly and combination of a pneumatically regulated air shock and a coiled spring for rotating the support arm.

BRIEF DESCRIPTION OF THE DRAWINGS

The present invention and the manner in which it may be practiced is further illustrated with reference to the accompanying drawings wherein:

FIG. 4 is a sectional view of an embodiment of a feeding support device of the invention.

FIG. 5 is a top sectional view of an embodiment of a feeding support device in accordance with the present invention taken generally along broken rectangular line 5 of FIG. 4.

DETAILED DESCRIPTION OF THE INVENTION

Figure 2:
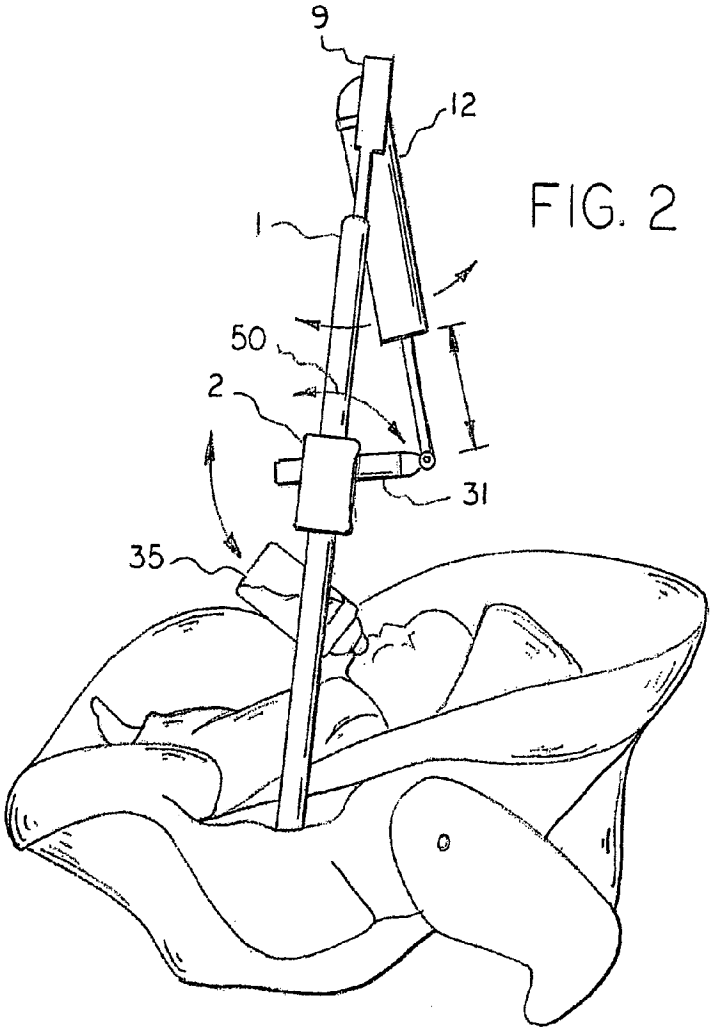
FIG. 2 is a side view of an embodiment of a feeding support device in accordance with the present invention shown attached to a carrier seat.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Figure 1:
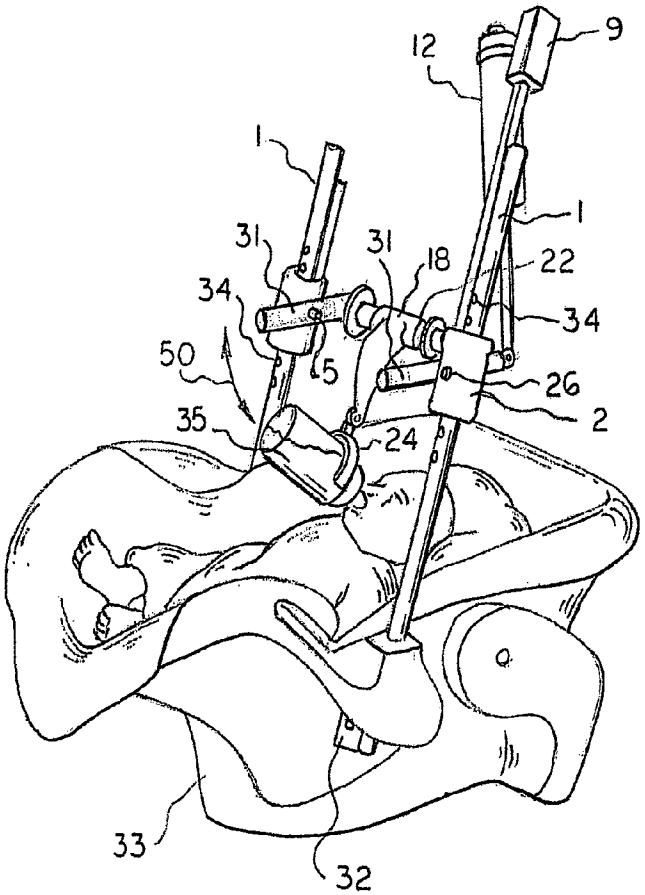
FIG. 1 is a front perspective view of a feeding support device in accordance with the present invention shown attached to a carrier seat.

With reference to FIG. 1, a feeding support device in accordance with the present invention is depicted coupled to a mount 32 of carrier seat 33. There it can be seen that the feeding support device is generally characterized by a bottle mounting bracket 18 which is attached to sturdy durable plastic hollow tubing which is mounted to a baby carrier. Pivotally attached to bottle-mounting bracket 18 is bottle mount 24 which in this preferred embodiment is operatively arranged to hold a baby bottle 35. The mounting assembly is attached to carrier seat 33 by support rods 1. Height adjustment tubes 2 slidably encase the support rods and are provided with adjustment holes 34 so that the holes are vertically aligned with a hole in adjustment tubes 2 and locked into place with locking pins 26. The rods and tubes are interlocked at required heights by inserting pins in designated inner aligned holes. Support arm 31 is rotatably attached to adjustment tubes 2 by swivel support pin 5. The entire assembly generally rotates in the direction of arrow 50 on the axis of swivel support pin 5. The support arm rotates on the swivel support pin (forward) clockwise (backwards) counter clockwise thus engaging feeding and disengaging feeding. The backwards motion is made possible by a coiled spring positioned around the swivel support pin attached to the bottle support arm and anchored on the height adjustment tube (shown in FIG. 4). Attached to height adjustment tube 2 is air shock control bracket 9, which attaches air shock 12 to support arm extension 22. The air shock which is pivotally attached to the air shock control bracket controls the withdrawal speed and elevation of the bottle support arm. While the preferred embodiment of the invention employs air shock 12 (a pneumatic cylinder) to control the rotation of the control arms, it should be obvious that other suitable means to control this motion are used, including, for example mechanical, electrical devices. The bottle position is held by the suction of the infant, once suction discontinues the coiled spring resistance disengages the bottle support arm at a pace controlled by the air shock and the bottle is repositioned away from the infant.

FIG. 2 is a side view of an embodiment of a feeding support device in accordance with the present invention shown attached to a carrier seat.

Figure 3:
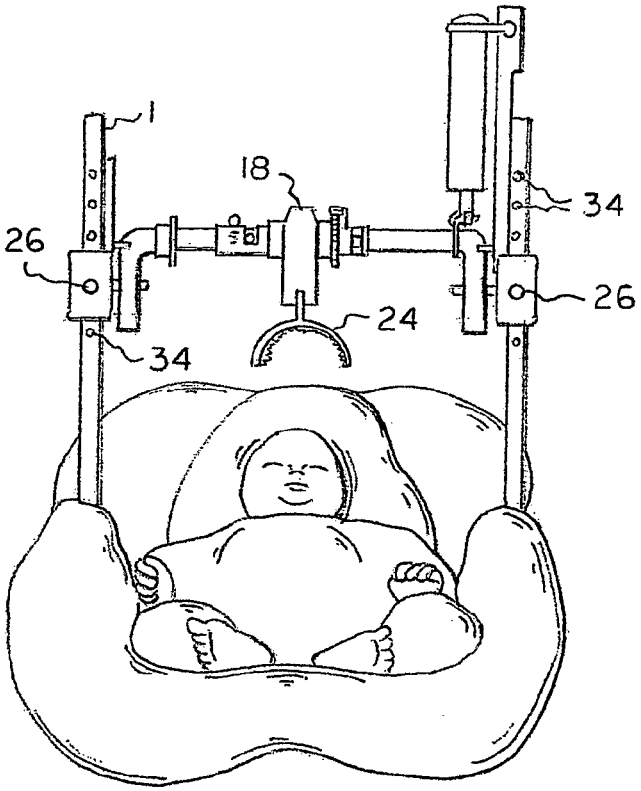
FIG. 3 is a front view of a feeding support device in accordance with the present invention shown attached to a carrier seat.

FIG. 3 is a front view of a feeding support device in accordance with the present invention shown attached to a carrier seat. In this view of the preferred embodiment of the invention the bottle mount is shown without a bottle. The device is positioned with locking pins 26 inserted into adjustment holes 34 of the height adjustment tubes which slidably encase the support rods so that the holes are vertically aligned and the device is locked into place.

FIG. 4 is a sectional view of an embodiment of a feeding support device of the invention. Support arm 31 is rotatably attached to adjustment tubes 2 by swivel support pin 5. The entire assembly generally rotates on the axis of swivel support pin 5. Coiled tension spring 8 surrounds swivel support pin 5 and is anchored into a small hole inside the base of the bottle support arm 31 (not shown). The spring applies tension which positions the control arms. The springs are torque coiled to keep the resistance on the bottle support arm in a counter clock force which is positioned at a designated point by support arm stopper 10 attached to the adjustment tubes on both sides. Attached to height adjustment tube 2 is air shock control bracket 9, which attaches air shock 12 to support arm extension 22. Air shock 12 is connected to air shock control bracket 9 by a ball joint clamp 11. The air shock is pivotally attached to the air shock control bracket and controls the withdrawal speed and elevation of the bottle support arm. When the device is engaged forward, coiled tension spring(s) 8 apply force during engagement and upon the return of the bottle support arm, air shock 12 (which is connected to the bottle support arm 31 by an o-ring connector 13 and set screw 14) controls the force of the return (disengagement) of the device. Without the air shock the arms would snap back ant an uncontrolled and violent rate.

Attached to a first bottle support arm 31 is support arm extension 22 which is a tube that fits inside the cylindrical opening of the first end of bottle-mounting bracket 18. Bottle-mounting bracket 18 rotates about the axis of support arm extension 22. Bottle mount 24 is rotatably secured at a second end of bottle-mounting bracket 18 by retainer pin 23. Bottle mount 24 is operatively arranged to hold a baby bottle with a fastener 25. In this view bottle mount 24 forms an open semicircle and is open on its bottom end. It should be appreciated by those of ordinary skill in the art that bottle mount 24 may be constructed with either a closed circular shaped end or an open end (as illustrated) to effectively hold a bottle. Fastener 25 can comprise any means well known in the art to affix a bottle to bottle mount 24, such as an adhesive, hook and loop fastener, or a suction cup device.

A second bottle support arm 31 is encased by support arm extension 16. Inside support arm extension 22 is an inner spring. Support arm extension 16 acts as a support and a locking tube for support arm extension 22. Dial 27 is fixedly attached to support arm extension 16 and arranged to adjust the torque of the inner spring. Setting indicator 29 displays the degree of torque measured in High, Medium, and Low (depending on the amount of fluid in baby's bottle 35 and the degree of baby's suction strength) which is locked into place by inserting pin 26.

Fixedly attached to bottle-mounting bracket 18 is a grooved mounted support arm sprocket 38. Clamp 20 secures support bracket 36 to support arm extension 22. Support bracket 36 holds pressure sprocket 37 in rotatable contact with mounted support arm sprocket 38. Pressure sprocket 37 rotates on the axis of pressure sprocket pin 39 and is provided with grooves that mate with the grooves of mounted support arm sprocket 38. Pressure sprocket 37 applies a controlled pressure and pressure sprocket pin 39 controls the rotation speed of bottle-mounting bracket 18. When a bottle is full of liquid the weight pulls the bottle-mounting bracket into the engaged position as the bottle empties or suction stops the tension applied from the inner spring pulls the bottle to a disengaged position. By tightening pressure sprocket pin 39 the rotation speed of bottle-mounting bracket is slowed sufficiently as to not interrupt the feeding process.

FIG. 5 is a top sectional view of an embodiment of a feeding support device in accordance with the present invention taken generally along broken rectangular line 5 of FIG. 4. This view shows the spring attachment of the bottle mount bracket inside of the bottle support arm and the spring tension torque adjustment assembly. Bottle-mounting bracket 18 has controlled rotation independent of the support arm rotation relative to swivel support pin 5. A second bottle support arm 31 and support arm extension 22 do not rotate relative to the rotation of bottle-mounting bracket 18. Bottle support arm 31 is a stationary tube that is encased by support arm extension 16 which is a tube have a slightly larger diameter than bottle support arm 31 and is arranged to turn about bottle support arm 31. Fixedly attached to the end of support arm extension 16 is the first end of coiled spring 30 and the second end of coiled spring 30 protrudes through a slot in support arm extension 22 which is aligned with a slot in bottle-mounting bracket 18. The second end of coiled spring 30 protrudes through the aligned slot in the bottle-mounting bracket and thus the tension or torque in coiled spring 30 controls the rotation speed of bottle-mounting bracket 18. Depending on the direction support arm extension 16 is turned about support arm 31 the tension in coiled spring 30 is either increased or decreased. Support arm extension 16 has multiple holes 44 at one end and is turned to align a hole 44 with stationary hole 40 of support arm extension 22 and stationary hole 42 of bottle support arm 31 (stationary hole 40 and stationary hole 42 are fixedly aligned). A removable interlocking pin 26 is inserted through all three aligned holes locking support arm extension 16 and thus the spring at a desired torque.

Dial 27 is fixedly attached to support arm extension 16 and arranged as a mechanism to turn the support arm extension and thus adjust the torque of the inner spring. Setting indicator 29 displays the degree of torque (i.e. measured in High, Medium, and Low).

Figure 6:
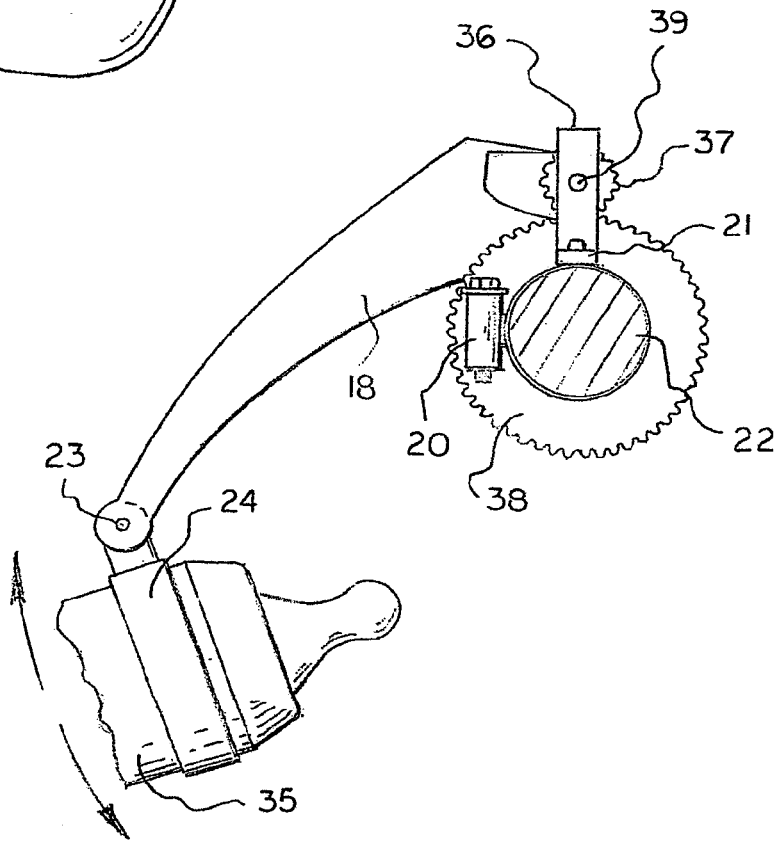
FIG. 6 is a cross sectional view of an embodiment of a support device in accordance with the present invention, taken generally along line 6—6 of FIG. 5.

FIG. 6 is a cross sectional view of an embodiment of a support device in accordance with the present invention, taken generally along line 6—6 of FIG. 5. Fixedly attached to bottle-mounting bracket 18 is a grooved mounted support arm sprocket 38. Clamp 20 and screw 21 secures support bracket 36 to support arm extension 22. Support bracket 36 holds pressure sprocket 37 in rotatable contact with mounted support arm sprocket 38. Pressure sprocket 37 rotates on the axis of pressure sprocket pin 39 and is provided with grooves that mesh with the grooves of mounted support arm sprocket 38. Pressure sprocket 37 applies a controlled pressure and pressure sprocket pin 39 controls the rotation speed and the retractable force of bottle-mounting bracket 18. Upon engagement pressure sprocket 37 applies pressure at a controlled resistance in conjunction with an infants' suction preventing too much resistance which would prematurely withdrawal the bottle out of baby's mouth every time it's engaged for feeding, but yet reserving enough torque upon discontinuation of feeding by baby to withdrawal the baby bottle 35 and disengage.

What I claim as my invention:

1. A feeding support device comprising:

a support arm that is rotatably attached to support rods;

a bottle-mounting bracket assembly rotatably mounted to the support arm;

a bottle mount having a first end attached to the bottle-mounting bracket assembly and a second end operatively arranged to fasten a bottle to the bottle mount;

a means for rotating the bottle-mounting bracket assembly; and a means for rotating the support arm.

2. The feeding support device recited in claim 1 wherein the means for rotating the support arm is a coil spring positioned between the support arm and the support rods.

3. The feeding support device recited in claim 2 wherein the motion of support arm is regulated by an air shock attached the support arm and the support rods.

4. The feeding support device recited in claim 1 wherein the means for rotating the rotating the bottle-mounting bracket assembly is a coil spring connected to and positioned within the support arm and connected to the bottle-mounting bracket assembly.

* * * * *